US006892850B2

(12) United States Patent
Suzuki et al.

(10) Patent No.: US 6,892,850 B2
(45) Date of Patent: May 17, 2005

(54) SURROUND FOR SPEAKER SYSTEM AND MANUFACTURING METHOD THEREOF

(75) Inventors: Takashi Suzuki, Yamagata-ken (JP); Masatoshi Sato, Yamagata-ken (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 10/393,998

(22) Filed: Mar. 24, 2003

(65) Prior Publication Data

US 2003/0188919 A1 Oct. 9, 2003

(30) Foreign Application Priority Data

Apr. 1, 2002 (JP) ..... 2002-098131
Oct. 3, 2002 (JP) ..... 2002-290640

(51) Int. Cl.[7] ..... H04R 7/10; H04R 31/00

(52) U.S. Cl. ..... 181/171; 181/172; 381/392; 29/594; 29/609.1

(58) Field of Search ..... 181/169, 166, 181/173, 171, 157, 172, 175, 158, 148; 381/386, 392, 428, 426, 425, 395, 398, 423; 29/594, 609.1; 264/46.8, 46.9, 255, 252

(56) References Cited

U.S. PATENT DOCUMENTS 4,377,617 A * 3/1983 Ikei et al. ..... 181/170
4,461,930 A * 7/1984 Melillo et al. ..... 381/190
5,031,720 A * 7/1991 Ohta et al. ..... 181/169
5,352,506 A * 10/1994 Sowa ..... 181/170
5,705,108 A * 1/1998 Nonogaki ..... 264/46.9
6,195,442 B1 * 2/2001 Griffin et al. ..... 381/396
6,390,232 B1 * 5/2002 Kirschbaum ..... 181/169
6,543,574 B1 * 4/2003 Mizone et al. ..... 181/171

FOREIGN PATENT DOCUMENTS

JP 55140396 A * 11/1980 ..... H04R/7/10
JP 56168495 A * 12/1981 ..... H04R/7/10
JP 57031297 A * 2/1982 ..... H04R/7/10
JP 59055698 A * 3/1984 ..... H04R/7/18
JP 59061295 A * 4/1984 ..... H04R/7/02
JP 62135099 A * 6/1987 ..... H04R/7/02
JP 62263798 A * 11/1987 ..... H04R/7/20
JP 03259699 A * 11/1991 ..... H04R/7/20
JP 2000092591 A * 3/2000 ..... H04R/7/20
JP 2000188796 A * 7/2000 ..... H04R/7/02
JP 2000-261885 9/2000

* cited by examiner

*Primary Examiner*—Edgardo San Martin
(74) *Attorney, Agent, or Firm*—Arent Fox, PLLC.

(57) ABSTRACT

A speaker's surround to be attached to an edge of a diaphragm in a speaker system is provided, which is capable of keeping its predetermined shape while repeating elastic deformation for accommodating large amplitude vibration of the diaphragm. Further, the surround is highly durable to withstand the repeated large amplitude vibration, and which can achieve high sound pressure levels. The surround for a speaker system includes a surround piece made of a rubber mold and a base member embedded in the surround piece. The base member is obtained by soaking a cloth material made of cotton or aramid fiber with a thermosetting resin such as phenol resin, and press-formed with heat into a predetermined shape. The surround thus has enhanced its shape maintaining capability.

8 Claims, 3 Drawing Sheets

SURROUND FOR SPEAKER SYSTEM AND MANUFACTURING METHOD THEREOF

BACKGROUND OF THE INVENTION

The present invention relates to a surround to be attached to the edge of a diaphragm of a speaker system, and a manufacturing method thereof.

The present application claims priority from Japanese Application Nos. 2002-098131 and 2002-290640, the disclosure of which is incorporated herein by reference.

Surround is a speaker component fitted to an outer peripheral edge of a diaphragm for flexibly supporting the diaphragm on a speaker frame. It is for holding the diaphragm in place and should satisfy the following requirements: an ability (linearity) to move the periphery of the diaphragm linearly when a driving force is applied to the diaphragm, an ability to suppress lateral vibration of the diaphragm, and good air tightness so that sound waves reflected by the backside of the diaphragm are not released to the front side thereof. It is also important that no intrinsic resonance occurs in the surround itself when it vibrates by the actuation of the diaphragm for the sound amplification.

Shape and material of a speaker's surround are thus designed according to desired speaker performances in consideration of these requirements. Surrounds for cone diaphragms are most commonly formed in a rolled shape which protrudes to the outside of the diaphragm, and made of a molded rubber or press-formed urethane foam. There are two methods of forming a surround at the edge of a diaphragm: One is a method of bonding a separately prepared surround to the edge of a diaphragm, and the other is a method of integrally forming a surround and a diaphragm made using different materials with a mold-set (see Japanese Patent Laid-open Publication No. 2000-261885).

In a high-power, high-output speaker system such as a subwoofer speaker system, a malfunction or breakage sometimes occurs in the surround, resulting from the large vibration amplitude of the diaphragm and the high pressure inside the speaker enclosure.

This is because the conventional speaker's surround has a rigidity which is insufficient for the high-power, high-output speaker system. When a negative pressure increases inside the speaker enclosure, the rolled surround protruding outwards is sucked inwards. The surround shape is deformed because of this inward buckling, whereupon the surround can no longer exhibit its abilities to move the diaphragm linearly, to suppress lateral vibration of the diaphragm, and to prevent intrinsic resonance of the surround itself. The diaphragm then moves irregularly and intrinsic resonance occurs in the surround, resulting in distortion at low sound levels and noises.

If the surround is made of a urethane foam material, it may eventually break, because the material cannot withstand repeated vibration with a large amplitude in the high-power, high-output speaker system.

The rigidity of the speaker's surround could be increased simply by making the material thickness larger, but this will increase its weight and lower the speaker efficiency, and high sound pressure levels can not be achieved.

SUMMARY OF THE INVENTION

The present invention has been devised under the circumstances described above, its object being to provide a speaker's surround which is capable of keeping its predetermined shape while repeating elastic deformation for accommodating large amplitude vibration of the diaphragm, which is highly durable to withstand the repeated large amplitude vibration, and which can achieve high sound pressure levels, and a manufacturing method thereof.

To achieve the above object, the present invention provides a surround for a speaker system and manufacturing methods thereof, having the following characteristic features:

According to one aspect of the present invention, there is provided a surround attached to an edge of a diaphragm in a speaker system, including a surround piece and a base member formed in a predetermined surround shape and embedded in the surround piece.

The base member may be made of a cloth material soaked with a thermosetting resin and formed into the surround shape by a heat and pressure treatment.

Preferably, the cloth material may have a regular hexagonal weaving pattern.

The surround piece may be obtained by molding a rubber material containing as its main component at least one member selected from the group consisting of isobutylene isoprene rubber, acrylonitrile butadiene rubber, styrene butadiene rubber, ethylene propylene diene monomer rubber, chloroprene rubber, isoprene rubber, ethylene propylene rubber, polynorbornene rubber, silicone rubber, epichlorohydrin rubber, and natural rubber.

According to another aspect of the present invention, there is provided a method of forming a surround to be attached to an edge of a diaphragm in a speaker system, including the steps of: setting a base member to be embedded in the surround in a mold-set for molding the surround; loading a surround piece raw material in the mold-set before or after the step of setting the base member; and applying heat and pressure to the base member and the surround piece raw material inside the mold-set, whereby the surround piece raw material is molded into a surround piece of a predetermined shape, and the base member is insertion-molded in the surround piece.

The base member may be formed into a predetermined surround shape before being set in the mold-set.

Alternatively, the base member may be set in the mold-set before being formed into a predetermined surround shape and molded into the predetermined shape by the mold-set.

According to still another aspect of the present invention, there is provided a method of forming a surround for a speaker system, including the steps of: forming a base member having a predetermined surround shape by heat press molding a cloth material soaked with a thermosetting resin; setting the base member in a mold-set for molding the surround; loading a surround piece raw material in the mold-set before or after the step of setting the base member; and applying heat and pressure for molding the base member and the surround piece raw material inside the mold-set.

According to yet another aspect of the present invention, there is provided a method of forming a surround for a speaker system, including the steps of: loading a surround piece raw material in a mold-set for molding the surround; setting a cloth material soaked with a thermosetting resin in the mold-set; and applying heat and pressure for molding the cloth material and the surround piece raw material inside the mold-set.

Preferably, the cloth material has a regular hexagonal weaving pattern.

The surround piece raw material may be made of a rubber material containing as its main component as least one member selected from the group consisting of: isobutylene isoprene rubber, acrylonitrile butadiene rubber, styrene butadiene rubber, ethylene propylene diene monomer rubber, chloroprene rubber, isoprene rubber, ethylene propylene rubber, polynorbornene rubber, silicone rubber, epichlorohydrin rubber, and natural rubber.

According to the surround for a speaker system of the present invention, the base member having a predetermined surround shape and embedded in the surround piece offers high shape memory properties, preventing the surround from being sucked inwards by a vacuum created inside the speaker enclosure. Distortion or noise caused by an abnormal behavior of the diaphragm is thereby prevented. The base member embedded in the surround piece also provides reinforcement, thereby preventing the surround from being broken (which phenomenon would otherwise occur due to repeated large amplitude vibration), thus enabling the surround to have a better durability. Therefore, the surround can suitably be used in a high-power, high-output speaker system.

The base member is made of a cloth material soaked with a thermosetting resin and formed into a surround shape by a heat and pressure treatment. Because the base member itself has the predetermined surround shape, it can further enhance the shape memory properties of the surround piece, which is made of a rubber mold. An increase in the weight may deteriorate speaker performance at high sound pressure levels, but the surround according to the present invention can be formed without increasing the weight as compared to conventional surrounds.

By adopting a cloth material having a regular hexagonal pattern for the base material of the surround, the strength characteristics of the surround during the vibration of the diaphragm are improved. The vibration of the diaphragm creates stress in various directions in the surround. However, if the base member, which provides strength for the surround, has a regular hexagonal weaving pattern, the surround will have a uniform strength distribution. This prevents a local concentration of stress on particular portions during large amplitude vibration. The surround thus has better durability, and a larger linear range can be achieved for higher sound pressure levels.

According to a method of forming the surround of the present invention, the base member, which is in either a flat shape or a pre-formed surround shape, is set inside a mold-set for forming the surround. This base member is then insertion-molded in the surround piece at the same time that surround piece raw material loaded in the mold-set is molded into the predetermined surround shape. This method has better productivity than a conventional method of separately bonding together surround piece and base member with an adhesive, because it involves fewer process steps. Also, this method is applicable both to a case in which surround is fabricated independently of other speaker element such as diaphragm, and a case in which a surround is formed integrally with a diaphragm by using a mold-set.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
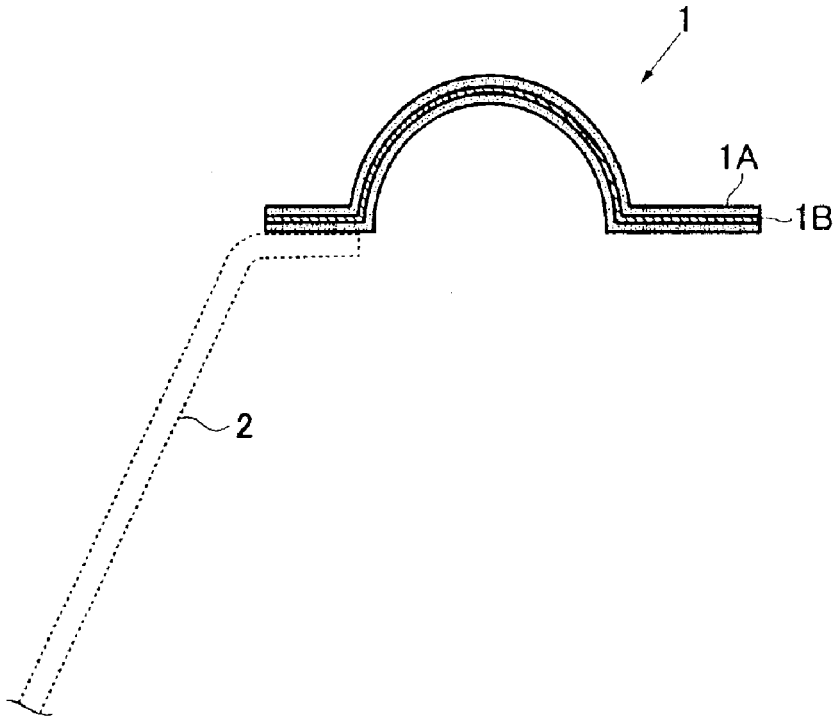
FIG. 1 is a cross section of a surround for a speaker system according to one embodiment of the present invention.

Preferred embodiments of the present invention will be hereinafter described with reference to the accompanying drawings. FIG. 1 is a cross section of a surround used in a speaker system. The surround 1 comprises a surround piece 1A and a base member 1B arranged in the surround piece 1A, and is formed in a rolled shape protruding to the front side. The surround 1 is provided to an outer edge of a cone diaphragm 2 shown by broken lines for flexibly supporting the cone diaphragm 2 on a speaker frame (not shown).

The surround piece 1A is formed by molding a rubber material containing as its main component at least one member selected from the group consisting of isobutylene isoprene rubber (IIR), acrylonitrile butadiene rubber (NBR), styrene butadiene rubber (SBR), ethylene propylene diene monomer rubber (EPDM), chloroprene rubber, isoprene rubber, ethylene propylene rubber, polynorbornene rubber, silicone rubber, epichlorohydrin rubber, and natural rubber. The base member 1B is obtained by soaking a cloth material made of cotton or aramid fiber with a thermosetting resin such as phenol resin, followed by a heat and press treatment so as to be formed into a desired surround shape.

Since the base member 1B, which keeps its predetermined surround shape, is embedded in the surround piece 1A made of a rubber material, the surround has enhanced shape memory properties and can withstand the sucking force caused by a vacuum created in the speaker enclosure. It can therefore prevent sound distortion or noise caused by an abnormal behavior of the diaphragm. Also because of the embedded base member which provides reinforcement, the surround does not easily break even with repeated large amplitude vibration and has improved durability.

Figure 2:
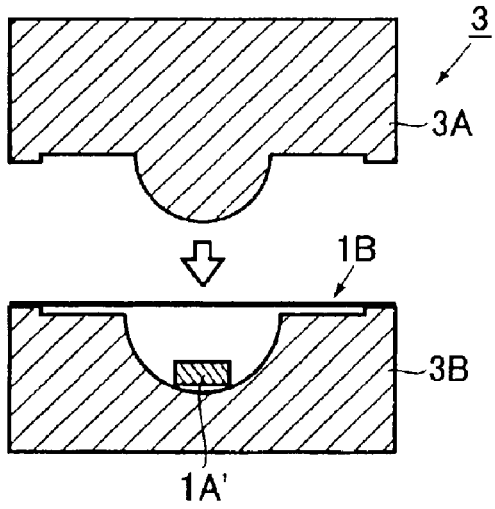
FIG. 2 is an explanatory diagram illustrating one embodiment of a method of forming a surround for a speaker system according to the present invention.
Figure 3:
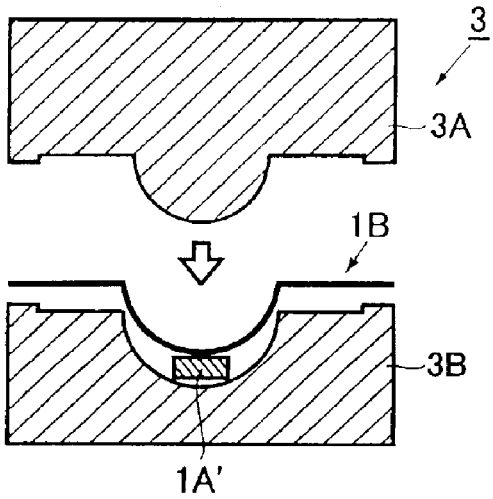
FIG. 3 is an explanatory diagram illustrating another embodiment of a method of forming the surround according to the present invention.
Figure 4:
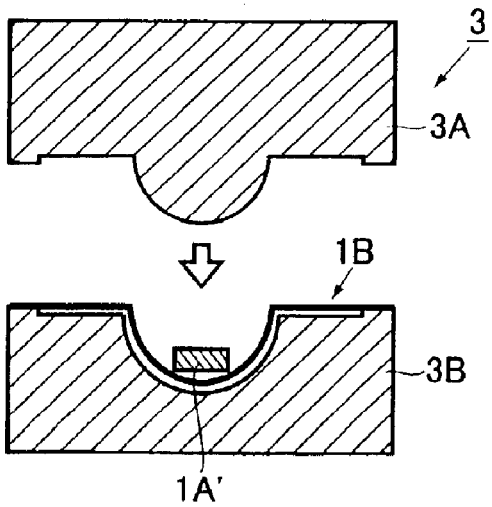
FIG. 4 is an explanatory diagram illustrating a further embodiment of a method of forming the surround according to the present invention.

FIG. 2 to FIG. 4 are diagrams illustrating embodiment of a method of forming such surround as described above. In the embodiment illustrated in FIG. 2, while raw material 1A' of the surround piece 1A is loaded inside the cavity of a mold-set 3 consisting of a male mold 3A and a female mold 3B, the base member 1B of a flat shape is placed upon the female mold 3B. The raw material 1A' is prepared in a strip-like form having a rectangular cross section as illustrated, and it is set inside the cavity formed by the female mold 3B. The base member 1B is obtained by soaking a cloth material made of cotton or aramid fiber with a thermosetting resin such as phenol resin. It is prepared in a ring shape and placed upon the open edge of the cavity formed by the female mold 3B.

The male mold 3A and female mold 3B are then closed as indicated by the arrow, and the materials are molded with heat and pressure at a temperature of about 150 to 200° C. Thereupon, the surround piece raw material 1A' melts and spreads to fill the mold gap between the male mold 3A and female mold 3B to vulcanize and form a surround piece 1A.

At the same time, the base member 1B is insertion-molded in the surround piece 1A, and also at the same time it is formed into the predetermined surround shape by the heat and pressure applied by the mold-set 3.

In the embodiment shown in FIG. 3, a base member 1B which is pre-formed to a predetermined surround shape is used. The base member 1B is obtained by soaking a cloth material made of cotton or aramid fiber with a thermosetting resin such as phenol resin, and formed into a desired surround shape by press-forming with heat. Raw material 1A' of the surround piece 1A is loaded inside the cavity formed by the female mold 3B, and the pre-formed base member 1B is placed thereupon. Similarly to the method described above, the male mold 3A and female mold 3B are closed as indicated by the arrow, and heat and pressure are applied, for insertion-molding the base member 1B in the surround piece 1A.

In the embodiment shown in FIG. 4, similarly to the method illustrated in FIG. 3, the base member 1B is made of a cloth material of cotton or aramid fiber soaked with a thermosetting resin such as phenol resin, and prepared in a desired surround shape by press-forming with heat. This base member 1B is first set in the cavity formed by the female mold 3B, and raw material 1A' of the surround piece 1A is placed thereon. The male mold 3A and female mold 3B are then closed as indicated by the arrow, and heat and pressure are applied, for insertion-molding the base member 1B in the surround piece 1A.

With these methods, surrounds can be manufactured with good productivity, because the forming of the surround piece 1A and the insertion-molding of the base member 1B having a predetermined surround shape in the surround piece 1A are performed at the same time. These methods are applicable both to a case in which surrounds are fabricated independently of other components, and a case in which they are formed in one piece with other components such as diaphragms. In the latter case, diaphragms are placed inside the cavity formed by the mold-set described above so that the forming of surrounds and mounting thereof on diaphragms are carried out at the same time.

Figure 5:
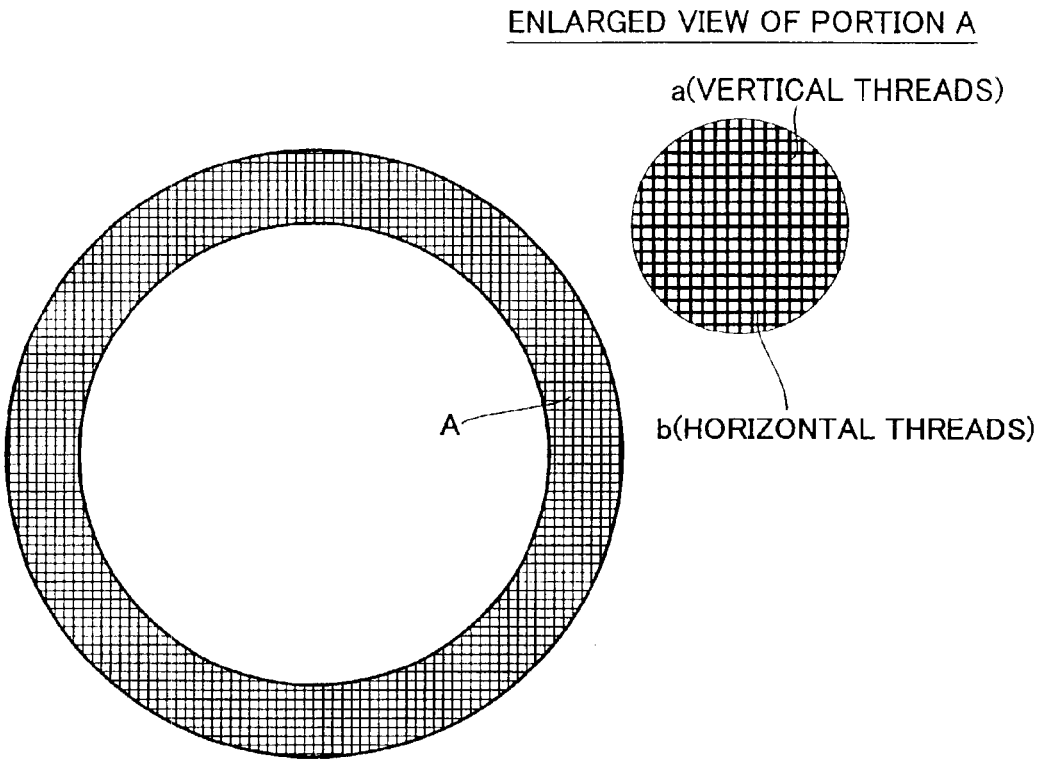
FIG. 5 is an explanatory diagram illustrating a base member of the surround for a speaker system according to one embodiment of the present invention.

The base member 1B is made of a cloth material as noted above. The weaving pattern of the cloth material can add favorable strength characteristics of the surround, whereby speaker performance can be improved. FIG. 5 is a top plan view of a cloth material for the base member 1B before being formed into the predetermined shape. If the surround is not for a speaker system capable of large amplitude outputs, a plain-woven cloth material having vertical threads (a) and horizontal threads (b) as shown in the drawing can be used.

This cloth material having such weaving pattern can exhibit high strength with respect to a stress exerted in an angle of 45° relative to vertical (a) and horizontal (b) threads because they both carry the stress equally. However, the cloth has a lower strength with respect to a stress in a direction along the vertical (a) or horizontal (b) threads, because only one of these threads carries the stress. Therefore troubles may occur because of a concentration of stress on weaker portions resulting from a large amplitude of vibration.

Figure 6:
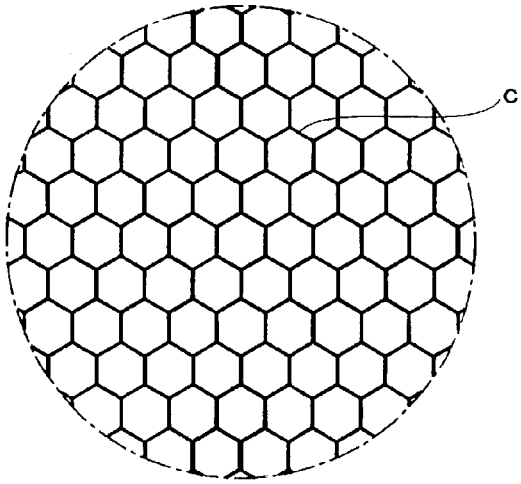
FIG. 6 is an explanatory diagram illustrating another base member of the surround for a speaker system according to one embodiment of the present invention.

A cloth material shown in FIG. 6 has fiber threads (c) in a regular hexagonal weaving pattern, which exhibits a uniform strength to a stress in various different directions. By adopting such regular hexagonal weaving pattern, a local concentration of stress is prevented, and therefore a large amplitude of vibration does not result in local indentations of the surround, whereby the linear range of increasing sound pressure level can be enlarged.

The surround for a speaker system according to the embodiments of the present invention described above is formed in a rolled shape, but the present invention is not limited to this and can be applied to any other shapes which are adopted for a speaker's surround.

According to the present invention, the surround attached to the edge of the diaphragm in the speaker system can keep its predetermined shape while repeating elastic deformation for accommodating large amplitude vibration of the diaphragm. It has high durability for withstanding the repeated large amplitude vibration, and can achieve high sound pressure levels. Thus the surround is suitable for a high-power, high-output speaker system such as a subwoofer speaker system.

By adopting a cloth material having a regular hexagonal pattern for the base material of the surround, the stress distribution of the surround during the vibration of the diaphragm is made uniform. This improves the strength characteristics of the surround and prevents a local concentration of stress on particular portions during vibration with a large amplitude. The surround thus has better durability, and a larger linear range can be achieved for higher sound pressure levels.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A surround to be attached to an edge of a diaphragm in a speaker system, said surround comprising:

a surround piece and a base member formed in a predetermined surround shape and embedded in the surround piece, wherein said base member is made of a cloth material soaked with a thermosetting resin and formed into the predetermined surround shape by a heat and pressure treatment, wherein said cloth material has a regular hexagonal weaving pattern.

2. The surround according to claim 1, wherein said surround piece is formed by molding a rubber material containing as its main component at least one member selected from the group consisting of isobutylene isoprene rubber, acrylonitrile butadiene rubber, styrene butadiene rubber, ethylene propylene diene monomer rubber, chloroprene rubber, isoprene rubber, ethylene propylene rubber, polynorbornene rubber, silicone rubber, epichlorohydrin rubber, and natural rubber.

3. A method of forming a surround to be attached to an edge of a diaphragm in a speaker system, comprising the steps of:

setting a base member to be embedded in the surround in a mold-set for molding the surround;

loading a surround piece raw material in said mold-set before or after said step of setting the base member; and applying heat and pressure to said base member and said surround piece raw material inside said mold-set, whereby said surround piece raw material is molded into a surround piece of a predetermined shape, and said base member is insertion-molded in said surround piece, wherein said base member is made of a cloth material soaked with a thermosetting resin and formed into the predetermined surround shape by a heat and pressure treatment, wherein said cloth material has a regular hexagonal weaving pattern.

4. The method of forming a surround according to claim 3, wherein said base member is formed into a predetermined surround shape before being set in said mold-set.

5. The method of forming a surround according to claim 3, wherein said base member is set in said mold-set before being formed into a predetermined surround shape and then molded into the predetermined surround shape by said mold-set.

6. A method of forming a surround for a speaker system, comprising the steps of:

forming a base member having a predetermined surround shape by heat press molding a cloth material soaked with a thermosetting resin;

setting said base member in a mold-set for molding the surround;

loading a surround piece raw material in said mold-set before or after said step of setting the base member; and applying heat and pressure for molding said base member and said surround piece raw material inside said mold-set, wherein said cloth material has a regular hexagonal weaving pattern.

7. A method of forming a surround for a speaker system, comprising the steps of:

loading a surround piece raw material in a mold-set for molding the surround;

setting a cloth material soaked with a thermosetting resin in said mold-set; and applying heat and pressure for molding said cloth material and said surround piece raw material inside said mold-set, wherein said cloth material has a regular hexagonal weaving pattern.

8. The method of forming a surround according to claims 3, 6 or 7, wherein said surround piece raw material is formed by a rubber material containing as its main component at least one member selected from the group consisting of isobutylene isoprene rubber, acrylonitrile butadiene rubber, styrene butadiene rubber, ethylene propylene diene monomer rubber, chloroprene rubber, isoprene rubber, ethylene propylene rubber, polynorbornene rubber, silicone rubber, epichlorohydrin rubber, and natural rubber.

* * * * *